United States Patent [19]

Abbott

[11] 3,930,291

[45] Jan. 6, 1976

[54] COMBINATION TENSION AND SLUB CATCHING DEVICE

[75] Inventor: Samuel L. Abbott, Wilton, N.H.

[73] Assignee: Abbott Machine Co., Inc., Wilton, N.H.

[22] Filed: May 6, 1974

[21] Appl. No.: 466,982

[52] U.S. Cl. ..... 28/64; 242/36

[51] Int. Cl.[2] ..... D02J 1/14; D02J 7/00

[58] Field of Search ..... 28/64; 242/36

[56] References Cited

UNITED STATES PATENTS

| | | | |
|---|---|---|---|
| 750,850 | 2/1904 | Hardman | 28/64 |
| 913,416 | 2/1909 | Metcalf | 28/64 |
| 1,734,590 | 11/1929 | McKean | 28/64 |
| 2,572,837 | 10/1951 | Brink | 28/64 |
| 2,657,450 | 11/1953 | Solliday et al. | 28/64 |
| 3,254,388 | 6/1966 | Abbott | 28/64 |
| 3,304,016 | 2/1967 | Abbott | 28/64 X |
| 3,461,520 | 8/1969 | Abbott | 28/64 |
| 3,501,820 | 3/1970 | Abbott | 28/64 |
| 3,543,357 | 12/1970 | Abbott | 28/64 |
| 3,769,668 | 11/1973 | Abbott | 28/64 |

*Primary Examiner*—Robert R. Mackey
*Attorney, Agent, or Firm*—Robert T. Gammons

[57] ABSTRACT

A combination slub catcher and tension control apparatus for use in the processing of yarn wherein a plurality of narrow parallel blades are supported at one side transversely to the path of travel of the yarn and a single rigid bar supported at the other side longitudinally of the path of the yarn. The confronting surfaces of the transversely and longitudinally supported blades and the bar define a narrow yarn passage. The transversely supported blades are supported in a holder in which they are individually yieldable to the passage of enlargements in the yarn and the longitudinally supported bar is supported on an eccentric for pivotal movement about an axis parallel to the transverse blades and for adjustment toward or from the transverse blades to adjust the width of the yarn passage. A tension lever is mounted on the upper end of the bar above the pivot axis for biasing the bar relative to the blades.

4 Claims, 8 Drawing Figures

COMBINATION TENSION AND SLUB CATCHING DEVICE

BACKGROUND OF INVENTION

Slub catchers and tensioning devices are the subject matter of numerous patents. In a recently issued U.S. Pat. No. 3,769,668 a device combining slub catching and tensioning was designed to enable reducing the distance involved in obtaining both slub removal and tensioning in one passage of the yarn as distinguished from most prior yarn processing apparatus wherein the slub removal and tensioning are performed at two different places along the path of the yarn travel. The combination device as shown in the aforesaid patent is embodied in a slub removing apparatus such as disclosed in U.S. Pat. Nos. 3,461,520, 3,501,820 and 3,543,357, wherein a plurality of narrow blades are supported transversely of the path of movement of the yarn at one side thereof and a single rigid bar supported longitudinally of the path of movement of the yarn at the other side and there is means for yieldably supporting the narrow blades for individual displacement and means for moving the entire array of narrow blades toward and from the rigid bar to change the width of the yarn passage. This invention is concerned with an improved structure for varying the width of the yarn passage, and improved means for applying tension to the yarn as it travels through the passage.

SUMMARY OF INVENTION

As herein illustrated, the combined slub catching and tensioning device is used in conjunction with apparatus for processing yarn, wherein there is means for unwinding yarn from a yarn mass and rewinding it and means for guiding a predetermined length of the yarn traveling from the mass to the package along a predetermined path and comprises at opposite sides of the yarn path in confronting relation to each other, means yieldably supported at one side and means pivotally supported at the other side having surfaces which collectively define an elongate yarn passage through which the yarn passes. The yieldably supported means is displaceable in a lateral direction at right angles to the yarn path and the pivotally supported means is pivotally supported for movement about an axis parallel to the yielding supported means and at right angles to the yarn path. The pivotally supported means is moveable toward and from the yieldably supported means to adjust the width of the yarn passage for selecting the slub size which is to be removed and there is means for biasing the pivotally supported means relative to the yieldably supported means to vary the pressure applied to the yarn as it travels through the yarn passage and thereby to vary the tension. The yieldably supported means as herein illustrated comprises a plurality of narrow blades supported transversely of the path of the yarn, each of which is yieldably independently to enlargements passing through the yarn passage and there is means for adjusting the resistance of these blades to displacement. The pivotally supported bar is mounted on an eccentric, rotation of which moves it toward and from the yieldably supported blades and a tension lever is mounted at the upper end of the pivotally supported bar above its pivot axis and extending laterally thereof for applying the biasing force to the pivotally mounted bar. The tension lever may be rotated to either side of the pivot axis and may be weighted. The pivot axis may be located above or below the center of the bar and the yieldably blades may be replaced by a single yieldably supported plate or the equivalent. Optionally two adjusting eccentrics may be substituted for the single eccentric, one fixed and the other allowing a limited opening and complete closure.

The invention will now be described in greater detail with reference to the accompanying drawings, wherein:

FIG. 1 diagrammatically illustrates the combination of slub catcher and yarn tensioning device mounted on the apron of a winding machine provided with a single winding head or multiple winding heads;

FIG. 2 is an elevation as seen in the direction of the arrows 2—2 of FIG. 1 to much larger scale;

FIG. 3 if a view partly in section taken on the line 3—3 of FIG. 1;

Figure 1:
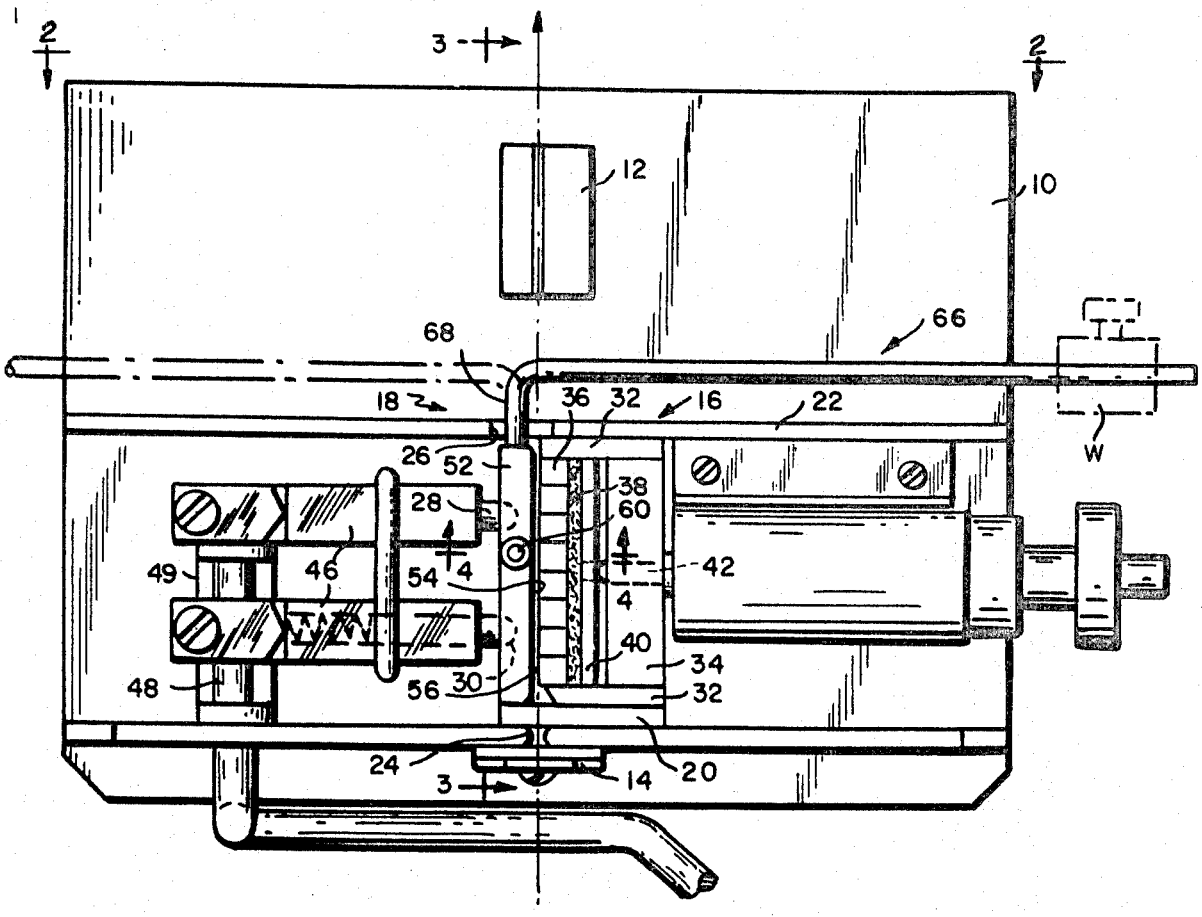

The invention as herein illustrated comprises a combination slub catching and tensioning device designed to be employed in processing yarn, for example, in conjunction with winding machines in which the winding units are stationary as shown in U.S. Pat. No. 2,277,574 or traveling as shown in U.S. Pat. No. 2,266,726 and wherein yarn is unwound form a yarn mass and rewound to form a package on which the yarn is laid up by a yarn traversing device. The length of yarn traveling from the mass to the package being wound is conventionally constrained to travel along a predetermined path by yarn guides and during such travel is subjected to slub catching and tensioning operations as shown in U.S. Pat. No. 2,623,265 wherein the slub catching and tensioning operations are carried out by separate independently operable devices. As herein illustrated the slub catching and tensioning operations are embodied in a single device which is supported on an apron 10 FIG. 1, between yarn guides 12 and 14 and comprises relatively fixed and moveable assemblies 16 and 18 supported in confronting relation to each other at opposite sides of the path of the yarn travel at their lower ends by a shelf member 20 secured to the apron and projecting horizontally forward therefrom and at their upper ends by a cover member 22 secured to the apron and projecting horizontally forwardly therefrom parallel to the shelf member 20. Both the shelf and the cover contain, respectively, yarn passages 24 and 26 which are in alignment with the yarn guides 12 and 14. The fixed assembly 16 is fastened to the apron between cover and shelf as will appear hereafter and the moveable assembly 18 is slideable forwardly and rearwardy with respect to the fixed assembly while being yieldably held engaged therewith by spring pressed plungers 28—28 supported with their ends engaged within openings 30—30 in the moveable member as will be described more fully hereafter.

The fixed assembly 16 comprises vertically spaced top and bottom members 32—32, and a back member 34. The members 32—32 and 34 collectively comprises a blade holder which is secured to the apron by bolts 35 and supports a plurality of narrow blades or bars 36 adjacent the path of travel of the yarn with the blades disposed in transverse relation to the path of travel of the yarn, that is, with their long axes projecting forwardly from the face of the apron. The blades 36 are attached by means of adhesive to a yieldable pad 38, such as felt which in turn is attached to a rigid metal plate 40. The plate 40 is moveable within the holder so that it is possible by moving the plate 40 to move the blades 36 in unison toward or away from the yarn path. The blades as thus supported are individually yieldable relative to the yarn path and moveable in unison toward and from the yarn path and there is means for adjusting the resistance of the entire array of blades and for adjusting the proximity of the array of blades relative to the yarn path comprising a spindle 42 yieldably supported in engagement with the rigid plate 40 within a barrel which is threaded into the back member to enable longitudinal adjustment of the spindle as shown in detail in U.S. Pat. No. 3,769,668. It is to be understood, however, that the blades 36 may be supported in the holder for adjustment relative to the yarn passage as shown in U.S. Pat. No. 3,543,357.

In the aforesaid U.S. Pat. No. 3,769,668 the blades 36 were employed to apply the yarn tensioning and to vary the width of the yarn passage to effect removal of slubs. In accordance with this invention the tensioning and the slub removing is effected by the moveable assembly 18. The blades 36 or thier equivalent are employed to soften the shock when a slub or other enlargement enters the yarn passage to avoid yarn breakage.

Figure 2:
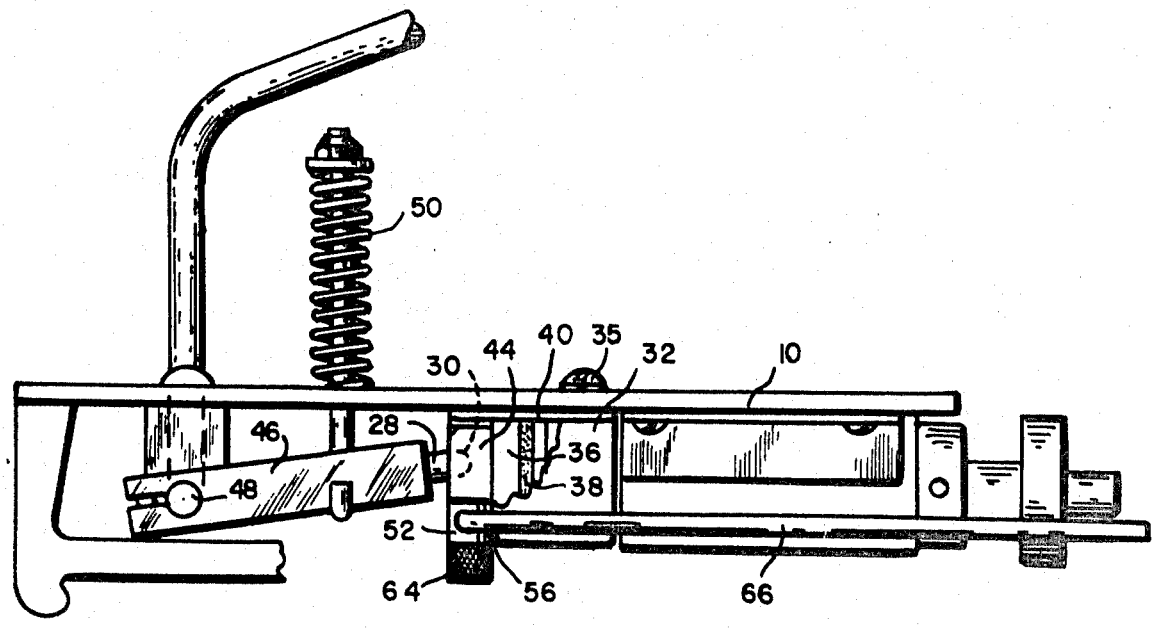
Figure 3:
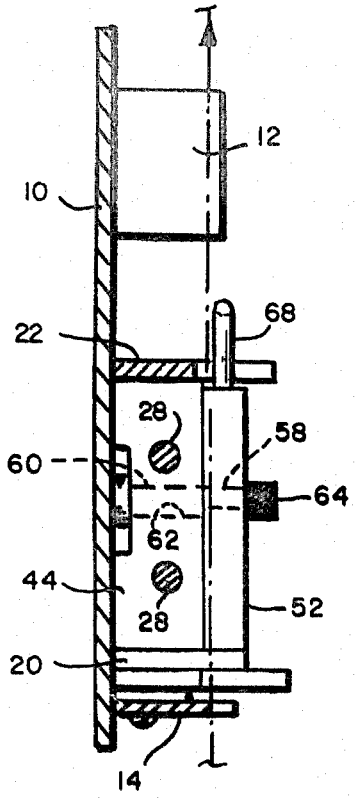
Figure 4:
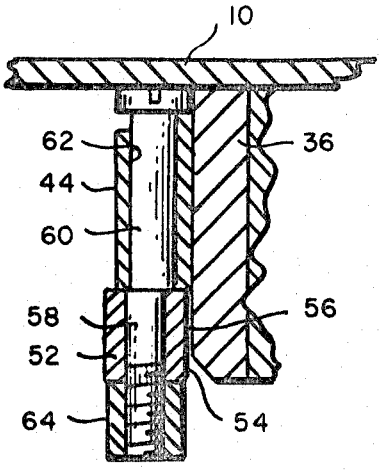
FIG. 4 is a fragmentary section taken on the line 4—4 of FIG. 1.

As shown in FIGS. 3 and 4 the moveable assembly comprises in part a rigid elongate block 44 supported at its lower end on the shelf 20 and yieldably held engaged with the blades 36 by the spring pressed plungers 28—28 previously referred to, the latter being mounted in pivotally supported arms 46—46. The arms 46—46 are fixed to a spindle 48 rotatably mounted in a bearing bracket 49 secured to the face of the apron and may be rotated as disclosed in my prior patents embodying this same construction to enable sliding the block 44 forwardly relative to the blades 36 for clearing the device of lint and the like. The arms 46—46 are normally biased rearwardly with with respect to the face of the apron as shown in FIG. 2 by spring means 50 so that the block is held against the apron. The block 44 is narrower from front to back than the blades 36 are long so that the blades project forwardly therefrom. A rigid bar 52 which has a flat uniformly smooth surface 54 substantially coextensive in length with the collective surfaces of the blades 36 from bottom to top is supported in a position in spaced relation to the forwardly projecting portions of the blades and forms therewith a yarn passage 56 the back of which is constituted by the forward edge of the block 44. The bar 52 is pivotally supported on an eccentric 58, FIGS. 3 and 4, at the forward end of a bolt 60 which is rotatably mounted in a hole 62 formed in the block 44 so that by rotating the bolt 60 the bar 52 may be moved toward and away from the blades 36 to adjust the width of the yarn passage 56. A nut 64 staked onto the bolt against the forward side of the bar 52 holds the bar 52 in place and provides for rotation of the eccentric. The bar is free to rock relative to the axis of the eccentric in any given position of adjustment.

As shown in FIG. 1 the bolt 60 is mounted in the block 44 above the center of the bar and there is mounted at the upper end of the bar a tension applying lever 66 which has a vertical part 68 pivotally supported in a socket 70 at the upper end of the bar 52 and a horizontal part 72 extending laterally therefrom. The tension lever 66 when disposed to the right hand side of the bar 52 as shown in FIG. 1 biases the bar 52 in a clockwise direction with respect to the axis of the eccentric thereby making the yarn passage narrower above the axis of the bolt than below it. By swinging the tension lever 66 to the left as shown in dot and dash lines in FIG. 1, the bar 52 may be biased in a counterclockwise direction to make the yarn passage narrower at the lower side of the axis of the eccentric and wider at the upper side. The tension applied by the tension lever may be varied by means of a weight W slideably mounted on the lever.

Figure 5:
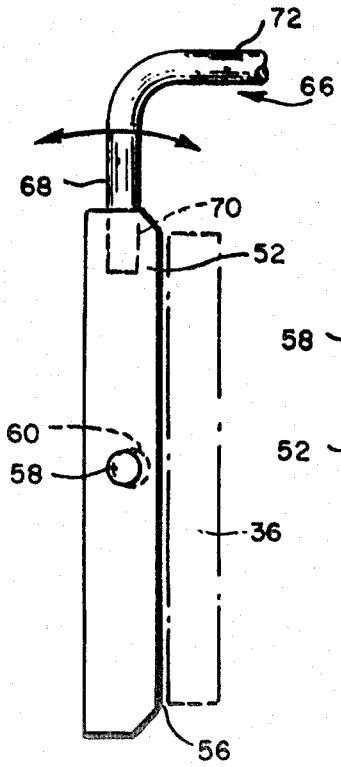
FIG. 5 is an elevation of the tension applying bar which forms one side of the yarn passage shown in relation to the yieldable blades which form the other side of the yarn passage.
Figure 6:
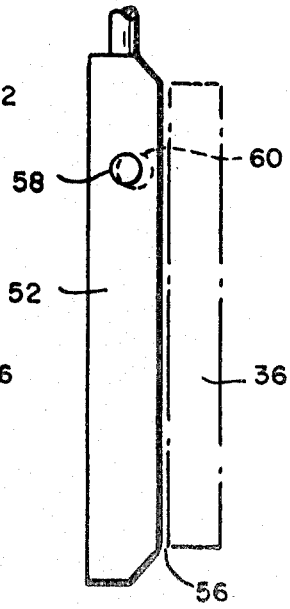
FIG. 6 is an elevation of the same bar pivotally supported for pivotal movement on an axis above the center.
Figure 7:
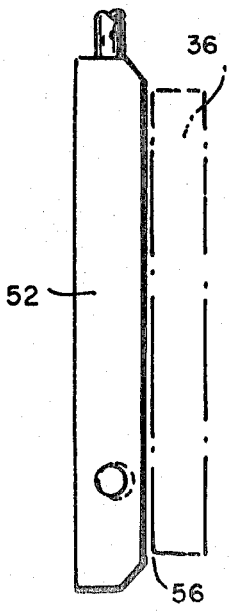
FIG. 7 is an elevation of the same bar pivotally supported for movement on an axis below its center.

The pivot axis provided by the bolt 60 may be located at the center of the bar as shown in FIG. 5, above the center as shown in FIG. 6 or below the center as shown in FIG. 7.

It will be observed that the bar 52 is beveled at its lower and upper ends and the lower end plate 32 is beveled at its forward end to provide for entrance of the yarn into the yarn passage and for leaving the yarn passage without undue scuffing. As thus constructed both the slub removal and tensioning operation are controlled by movement of the bar 52 relative to the blades 36, the latter as explained above functioning solely as cushion means to prevent undue breakage of yarn. The eccentric provides for adjusting the width of the yarn passage hence the size slub permitted to pass and the tension lever provides for adjusting the tension applied to the yarn as it travels through the yarn passage. When the bar 52 is supported as shown in FIG. 6; for pivotal movement about an axis above its midlength, the tension lever tends to close the upper part of the bar 52 against the blades 36. A short slub or nib entering the passage will tend at first to displace the bar at the lower end and hence close the passage above the pivot axis so as to compensate for the loss of frictional engagement of the yarn with the yarn passage due to the presence of the slub. As the slub travels upwardly it will be subjected to the closest unrelieved pressure except for the yield of blades 36 at the pivot axis and if too large will break the yarn. If it passes beyond this point it will tend to displace the upper part of the bar in the opposite direction, that is, away from the blades 36 thus relieving the pressure on the slub and applying a compensating pressure to the yarn below the pivot axis. A large slub or double spun portion entering the yarn passage which is of such length as to fill the entire passage, that is, extends the full length of the yarn passage from bottom to top will be subjected to the full pressure of the blades 36. In this case there will be a little more pressure above the pivot axis because of the load applied by the tension lever 66.

The yieldable blades 36 or their equivalent are necessary to absorb the shock of a slub entering the lower end of the yarn passage which otherwise tends to break the yarn acting somewhat as felt washers do instead of tensioning devices.

By shifting the pivot axis of the eccentric the length of the bar 52 which may be disposed at an angle to the bars 36 above and below the pivot axis may be varied for different conditions.

adjacent end portions to said open condition thereof by a force applied thereto in a direction towards the actuating member when said adjacent end portions are in said closed condition thereof.

4. A coupling device according to claim 1, wherein the housing is provided with a slot having an open end and within which said adjacent end portions of the closure members are disposed when in said closed condition.

5. A coupling device according to claim 1 wherein the ends of the opposed closure members remote from said adjacent end portions thereof are integrally interconnected, the closure members being mounted in the housing by securement of said remote ends of the closure members to the housing.

* * * * *

UNITED STATES PATENT OFFICE

CERTIFICATE OF CORRECTION

Patent No. 3,930,291 Dated January 6, 1976

Inventor(s) Samuel L. Abbott

It is certified that error appears in the above-identified patent and that said Letters Patent are hereby corrected as shown below:

The last page should be deleted and the attached page substituted therefor.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*

If the axis is mid-way between the ends of the bar 52, the pressure exerted on either side of the axis is approximately the same. By mounting the pivot axis above the mid-length, FIG. 6, the slubbing action may be carried out over a relatively long path which enables the enlargements to become pressed and to pass through without breaking, and by mounting the pivot axis below mid-length, FIG. 7, the slubbing action may be carried out over a relatively short path which enables eliminating even the shortest slubs.

Figure 8:
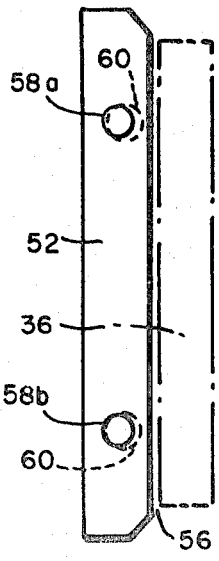
FIG. 8 is an elevation of the bar supported on two eccentrics.

In place of a single eccentric supporting the bar 52, two adjusting eccentrics 58*a*, 58*b*, FIG. 8, may be employed, one of which may be fixed so as to provide for a limited opening and complete closure of the yarn passage and the other a fixed opening. For example, the eccentric 58*b* may be placed near the bottom to provide a maximum opening to 0.010 and the eccentric 58*a* at the top to enable varying the opening from a maximum 0.010 to 0.000.

As herein described the tension and slub catching device is used in conjunction with the sliding block type of slub catcher shown in the aforementioned patents wherein the blades 36 which form one side of the yarn passage are individually yieldably, however, it should be understood that it may be used with a structure such as shown in U.S. Pat. NO. 2,623,265 wherein a single plate is employed to form one side of the yarn passage. Without some resilence or yieldable surface, the forces incurred in moving the whole mass, of the bar 52 and tension arm would break the yarn.

It should be understood that the present disclosure is for the purpose of illustration only and that this invention includes all modifications and equivalents falling within the scope of the appended claims.

I claim:

1. Slub catching and tension for processing yarn comprising means for unwinding yarn from a control apparatus package and rewinding it to form a package and means for guiding a portion of the yarn as it travels from one package to the other comprising blocks supported at opposite sides of the path of yarn travel, means yieldably supported by the block at one side, providing a surface extending lengthwise of the path of yarn travel, an eccentric mounted on the block at the other side, an elongate bar mounted on the eccentric for pivotal movement about an axis parallel to the surface of said means at said one side and for adjustment relative thereto to adjust the width of the yarn passage, a lever mounted at the upper end of the bar and extending laterally therefrom relative to said pivot axis for biasing the bar on said axis and means mounting the lever for movement to either side of said axis.

2. Apparatus according to claim 1, wherein said lever is weighted.

3. Slub catching and tension control apparatus for processing yarn comprising means for unwinding yarn from a package and rewinding it to form a package, and means for guiding a portion of the yarn as it travels from one package to the other, comprising supports at opposite sides of the path of yarn travel, means yieldably mounted on the support at one side providing a surface extending lengthwise of and parallel to the path of yarn travel, an eccentric rotatably mounted on the support at the other side with its axis of rotation at right angles to the path of travel of the yarn and parallel to said surface provided by the yieldably supported means, means mounted on the eccentric providing a surface spaced from and parallel to said surface provided by the yieldably supported means and forming in conjunction therewith a narrow yarn passage, said eccentric pivotally supporting said latter means for pivotal movement about said axis and for movement by rotation of the eccentric relative to said surface to adjust the width of the yarn passage, a lever mounted on said latter means above said axis and extending laterally therefrom relative to said axis for biasing said latter means on said axis and means mounting the lever for movement to either side of said axis.

4. Apparatus according to claim 3 comprising, means for rotating the eccentric.

* * * * *